US007417363B2

(12) United States Patent
Koenigsberg et al.

(10) Patent No.: US 7,417,363 B2
(45) Date of Patent: Aug. 26, 2008

(54) CONTAINMENT VESSEL FOR LIGHT SOURCE CAPSULES OPERATING AT OTHER THAN THE PRESSURE OF A SURROUNDING GAS

(75) Inventors: William D. Koenigsberg, Concord, MA (US); David W. Johnston, Kensington, NH (US); John H. Selverian, North Reading, MA (US); David Wentzel, Eliot, ME (US); Walter P. Lapatovich, Boxford, MA (US)

(73) Assignee: Osram Sylvania Inc., Danvers, MA (US)

( * ) Notice: Subject to any disclaimer, the term of this patent is extended or adjusted under 35 U.S.C. 154(b) by 279 days.

(21) Appl. No.: 11/301,504

(22) Filed: Dec. 13, 2005

(65) Prior Publication Data

US 2007/0132397 A1 Jun. 14, 2007

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl. ..... 313/25; 313/634

(58) Field of Classification Search ..... 313/634, 313/25, 33, 34, 44, 317, 515, 567, 577, 623, 313/636

See application file for complete search history.

(56) References Cited

U.S. PATENT DOCUMENTS

| | | | | | |
|---|---|---|---|---|---|
| 3,764,844 | A | * | 10/1973 | Schmidt | 313/110 |
| 4,178,534 | A | * | 12/1979 | McNeill et al. | 315/39 |
| 4,772,819 | A | * | 9/1988 | Ridders | 313/493 |
| 4,801,846 | A | * | 1/1989 | Kramer et al. | 313/641 |
| 4,942,330 | A | * | 7/1990 | Karlotski et al. | 313/25 |
| 4,950,938 | A | * | 8/1990 | Ramaiah | 313/25 |
| 5,128,590 | A | * | 7/1992 | Holzer | 315/58 |
| 5,729,078 | A | * | 3/1998 | Pragt | 313/25 |
| 6,064,155 | A | * | 5/2000 | Maya et al. | 315/56 |
| 7,053,555 | B2 | * | 5/2006 | Fujiwara et al. | 313/635 |

* cited by examiner

*Primary Examiner*—Sikha Roy
*Assistant Examiner*—Brian T Schoolman
(74) *Attorney, Agent, or Firm*—William E. Meyer

(57) ABSTRACT

A high intensity discharge lamp (10) has an envelope (12) having a base end (12*a*), a middle portion (12*b*) and domed end (12*c*) arrayed along an envelope longitudinal axis (14). Two spaced apart electrical lead-ins (34, 36) are sealed in the base end (12*a*) and extend into the envelope (12). A substantially U-shaped frame (38) is within the envelope (12) and the U-shaped frame comprises glass tubing 26*a*. A light source (16) has an arc discharge capsule (16*b*) positioned within the frame (38) and a containment vessel (18) is spaced from and surrounds the arc discharge capsule 16*b*. The containment vessel (18) comprises a transparent structure (19) attached to the frame (38) and formed to provide multiple, independent, localized fractures capable of absorbing the given kinetic energy possessed by the shards.

24 Claims, 8 Drawing Sheets

CONTAINMENT VESSEL FOR LIGHT SOURCE CAPSULES OPERATING AT OTHER THAN THE PRESSURE OF A SURROUNDING GAS

TECHNICAL FIELD

This invention relates to lamps and more particularly to such lamps having a light source capsule that operates at an internal pressure greater than or less than the pressure of a gas surrounding the capsule. Such lamps include tungsten halogen lamps and arc discharge lamps, such as metal halide arc discharge lamps.

BACKGROUND ART

Lamps such as those described above usually have a light source capsule that is enclosed in an outer envelope that can be evacuated or contain an inert gas. The light source capsule can be subject to bursting if its internal pressure is greater than or less than the pressure of the gas surrounding the capsule. A burst of a light source capsule can shatter the outer envelope and thereby create a dangerous situation. To provide a measure of protection from such bursts it has been the industry practice to enclose the lamp in a protective fixture or to provide an unusually robust outer envelope to contain any shards from the burst capsule.

In particular, metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. The arc tube, itself hermetically sealed, has tungsten electrodes sealed into opposite ends and contains a fill material that can include mercury, as well as metal halide additives, and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide such lamps, and in particular, metal halide arc discharge lamps with a shroud that comprises a generally light-transmissive member, such as quartz, that is able to withstand high operating temperatures. The arc tube and the shroud are coaxially mounted within the lamp envelope with the arc tube located within the shroud. Preferably, the shroud is tubular and open at both ends. In other cases, the shroud is open on one end and has a domed configuration on the other end. Shrouds for metal halide arc discharge lamps are disclosed in U.S. Pat. No. 4,499,396 issued Feb. 12, 1985 to Fohl et al. and U.S. Pat. No. 4,580,989 issued Apr. 8, 1986 to Fohl et al. See also U.S. Pat. No. 4,281,274 issued Jul. 28, 1981 to Bechard et al.

The shroud has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to elevate and/or equalize the surface temperature of the arc tube. In addition, the shroud effectively reduces sodium losses and improves the maintenance of phosphor efficiency in metal halide lamps having a phosphor coating on the inside surface of the outer envelope. Finally, the shroud improves the safety of the lamp by acting as a containment device in the event that the arc tube shatters.

While these shrouded lamps have received great acceptance in the marketplace, (since lamps so equipped do not require an extensive, enclosed fixture) the use of the quartz shroud adds considerable expense, and considerable weight, to the lamp. Additionally, these lamps employ a wire frame to mount the arc tube and the shroud, and this wire frame can contribute to a loss of sodium from the arc tube, which loss affects the color output of the lamp as well as the life of the lamp and, additionally, contributes an undesired shadow.

Further, the quartz shroud is a single piece that favors a single (or very limited number) continuous 'global' fracture when struck by an arc tube shard because of its nearly uniform rigid continuum structure and the fact that crack propagation velocity in quartz tubing is in the neighborhood of ~2000 m/sec. This velocity is much greater than the nominal shard/envelope impact velocity of about 25 m/sec. Therefore, an initiating crack spreads elsewhere around the shroud before other shards have a chance for their own impacts. This behavior can weaken the tubular shroud at locations other than the initial impact site and can yield relatively large fragmented pieces of shroud and/or light source capsule. Subsequent shard impacts at these other locations are met with significantly reduced barrier strength. The shards are propelled toward the inner surface of the outer envelope by expanding gases from the light source capsule burst. Therefore, it is possible under some conditions for the shroud to contribute to the fracture of the outer envelope, the very situation it was supposed to prevent.

DISCLOSURE OF INVENTION

It is, therefore, an object of the invention to obviate the disadvantages of the prior art.

It is another object of the invention to enhance the operation of metal halide arc discharge lamps.

Yet another object of the invention is elimination of unwanted shadow effects from the lamp.

Yet another object of the invention is the provision of a structure that prevents large shards from engaging an outer envelope.

Still another object of the invention is the provision of an integral frame and containment structure for lamps employing a light source capsule that, at least during operation, contains an atmosphere at a pressure different from the pressure of the gas surrounding it.

These objects are accomplished, in one aspect of the invention, by a lamp having an envelope with a longitudinal axis and with a light source capsule contained therein, said light source capsule being capable of shattering into shards with a given kinetic energy able to fracture said envelope, the improvement comprising: a containment vessel spaced from and surrounding said light source capsule, said containment vessel comprising a transparent structure formed to provide multiple, independent, localized fractures capable of absorbing said given kinetic energy.

This containment vessel itself will not generate large shards and effectively reduces the kinetic energy of the shards to protect the outer envelope and contain all of the shards.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
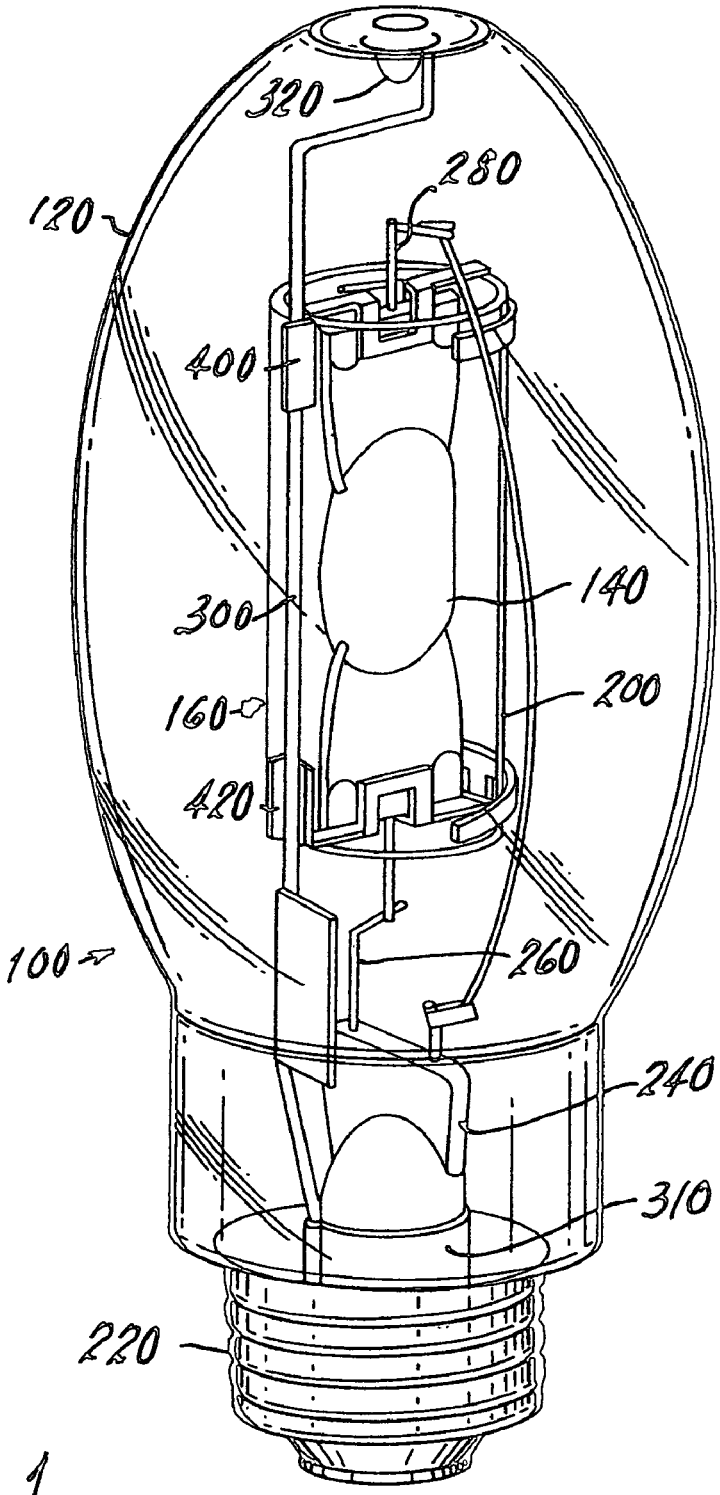
Fig. 1 PRIOR ART
FIG. 1 is a perspective view of an exemplary prior art type of protected high intensity discharge lamp.

Referring now to the drawings with greater particularity, there is shown in FIG. 1 a prior art metal halide arc discharge lamp 100 including a lamp envelope 120 and an arc tube 140 mounted within the envelope by mounting frame 160. The arc tube is positioned within a shroud 200 which can also be supported by the mounting frame 160. Electrical energy is coupled to the arc tube 140 through a base 220, a lamp stem 240 and electrical leads 260 and 280. The arc tube contains a chemical fill or dose of materials to provide light when an arc is initiated therein, as is known. The shroud 200 comprises a cylindrical tube of light transmissive, heat resistant material such as quartz.

A wire mounting frame 160 supports both the arc tube 140 and the shroud 200 within the lamp envelope 120. The mounting frame 160 includes a metal support rod 300 attached to lamp stem 240 by a strap 310. The support rod 300 engages an inward projection 320 in the upper end of the lamp envelope 120. The support rod 300 in its central portion is parallel to a central axis of the arc tube 140 and shroud 200. The mounting means 160 further includes an upper clip 400 and a lower clip 420, which secure both arc tube 140 and shroud 200 to support rod 300. The clips 400 and 420 are attached to the support rod 300, preferably by welding.

Figure 5:
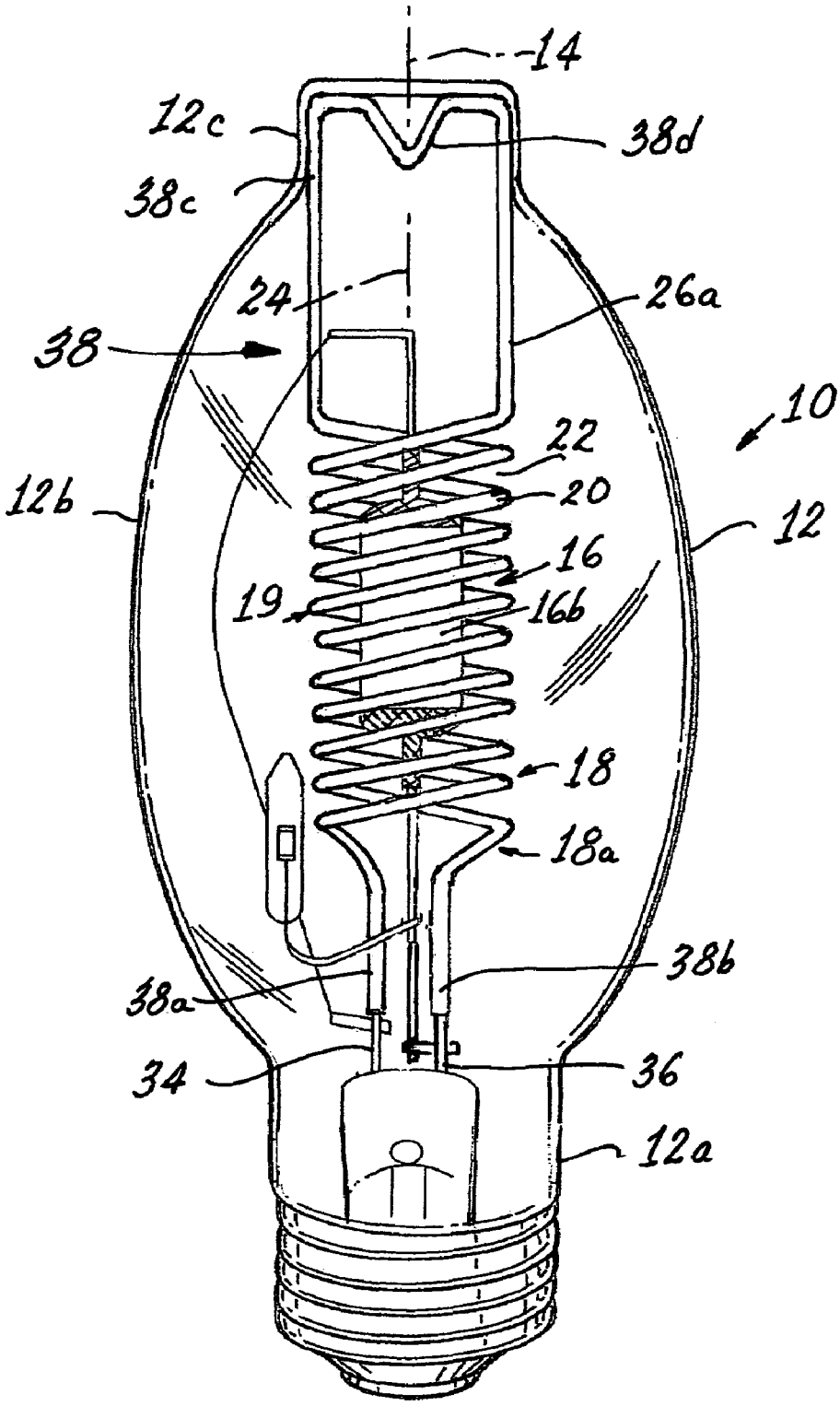
FIG. 5 is an elevational view of an embodiment of the invention employed with an arc discharge lamp.

Referring now to FIG. 5, there is shown a lamp 10 having an envelope 12 with a longitudinal axis 14 and with a light source capsule 16 contained therein. The light source capsule 16 can be an arc discharge tube 16*b*, such as for a metal halide lamp, or a filamented lamp capsule 16*c* (see FIG. 6) that operates at a pressure greater than or less than the pressure of a surrounding gas and is therefore capable of shattering into shards with a given kinetic energy able to fracture the envelope 12. The lamp 10 contains a containment vessel 18 that is spaced from and surrounds the light source capsule 16. The containment vessel 18 comprises a transparent structure 19 that is formed to provide multiple, independent, localized fractures capable of absorbing the given kinetic energy possessed by the shards in the event of a capsule burst. The light source capsule 16 can be mounted within the containment vessel 18 by any suitable means.

The transparent structure 19 is selected from glass or ceramic and has alternating solid areas 20 and spaces 22. In a preferred embodiment the containment vessel 18 is a helix 18*a* having a helix longitudinal axis 24 substantially coaxial with the envelope longitudinal axis 14.

The helix 18*a* (see FIG. 4) is preferably constructed of glass tubing 26, such as an aluminosilicate glass, and the spaces 22 are formed between turns of the helix 18*a*. Suitable glasses for construction of the helix are Type 1724 from Corning Glass Company, Schott Glass 8252, from Schott Glass Company and GE Type 180, from General Electric Company.

Figure 2:
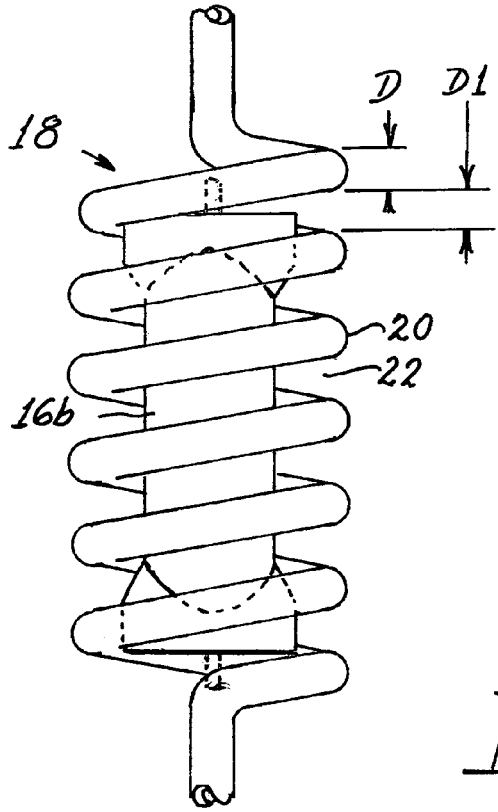
FIG. 2 is an elevational view of an embodiment of the invention.
Figure 6:
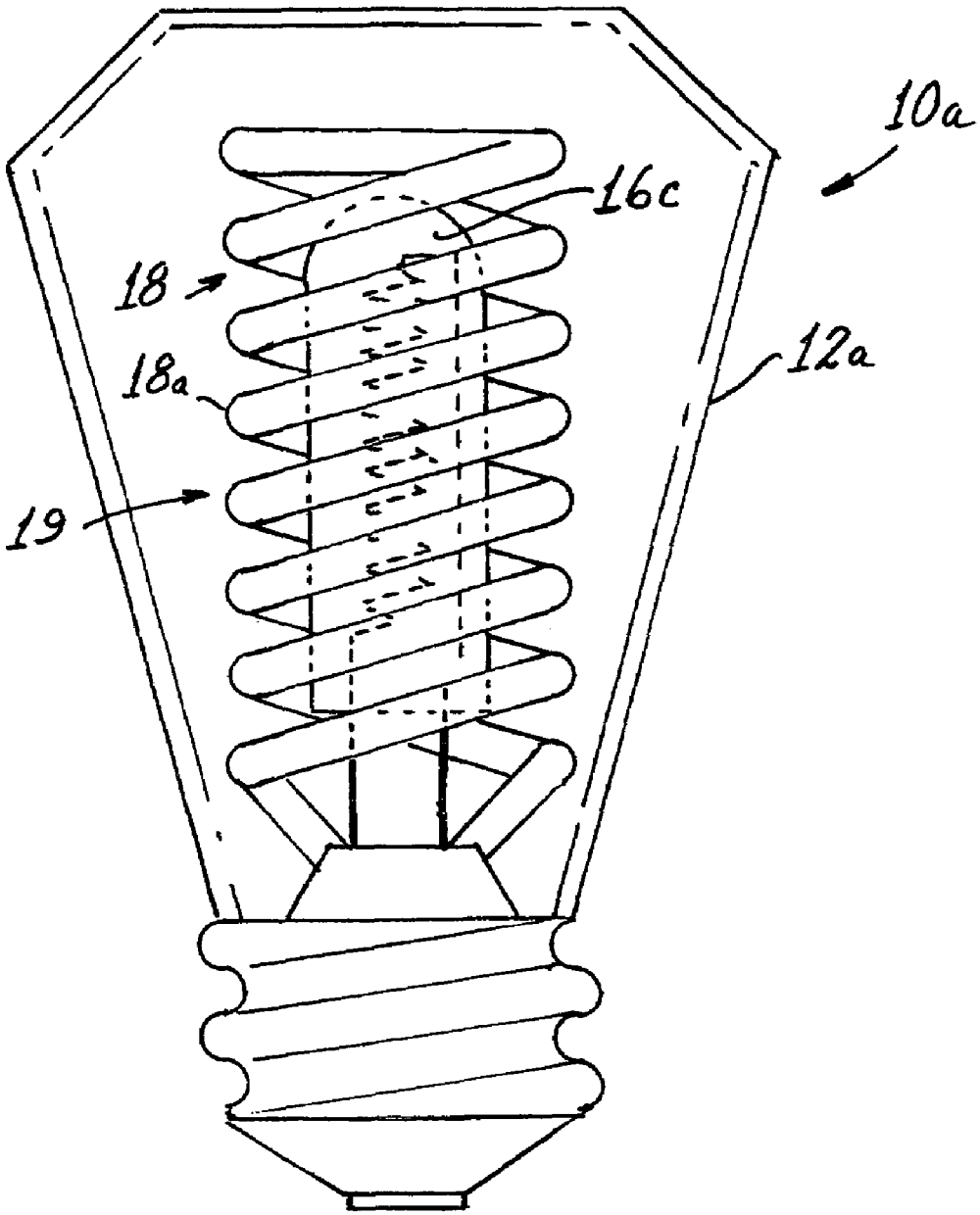
FIG. 6 is an elevational view of an embodiment of the invention employed with a filamented lamp.

The helix can be a single helix as shown in FIG. 2 or a bifilar helix as shown in FIGS. 5 and 6, with the bifilar helix being preferred.

Figure 3:
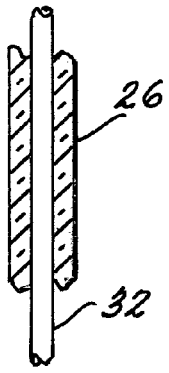
FIG. 3 is a partial, elevational sectional view of one form of structure that can be employed with the invention.
Figure 4:
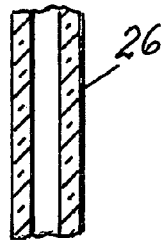
FIG. 4 is a partial, elevational sectional view of a second form of structure that can be employed with the invention.

The glass tubing 26 can remain empty, as shown in FIG. 4 or it can have a wire, 32 threaded therethrough, as shown in FIG. 3. It is not necessary that the wire have an external diameter matching that of the internal diameter of the tubing and, preferably, the external diameter of the wire is as small as practicable to reduce unwanted shadowing effects.

Figure 9:
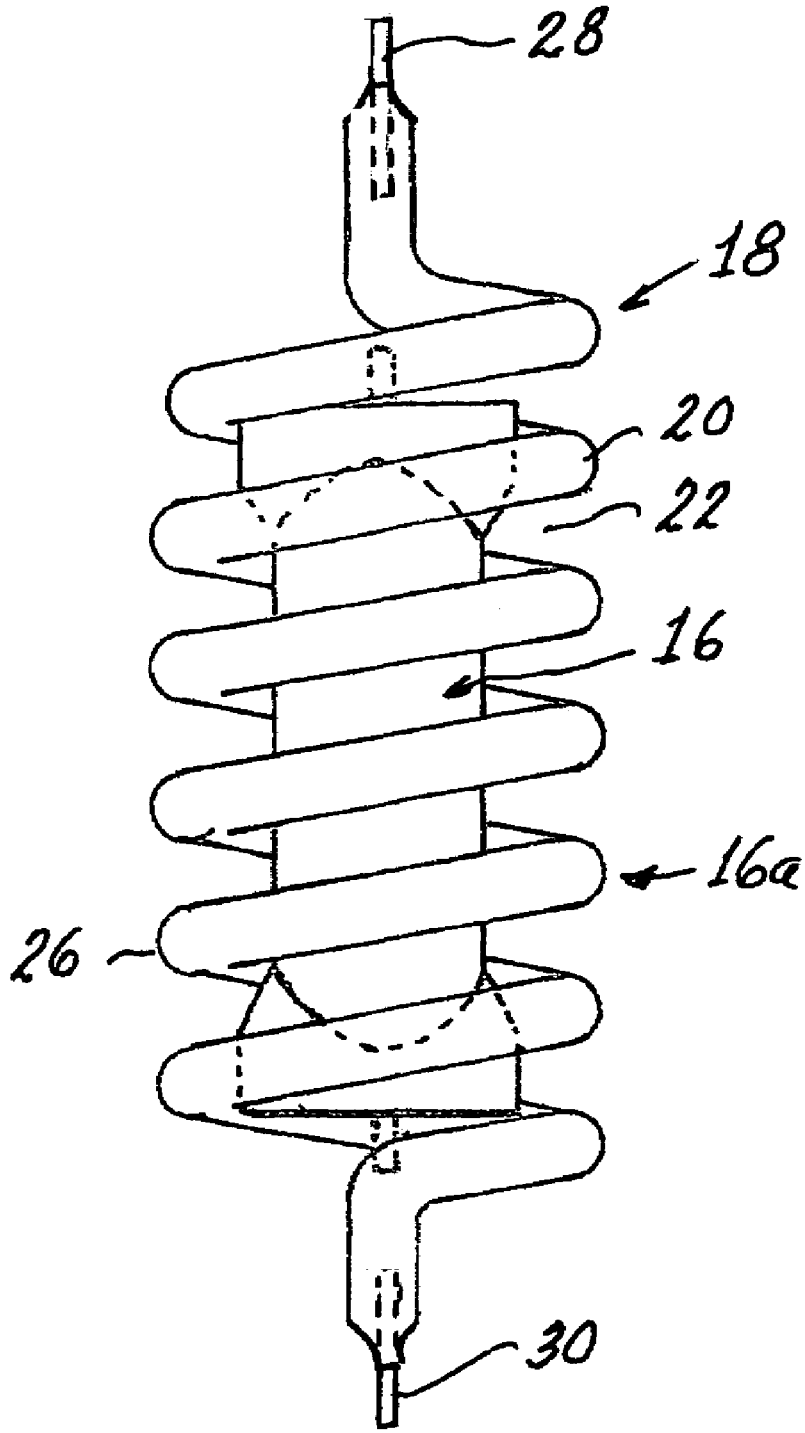
FIG. 9 is an elevational view of yet another embodiment of the invention.

Alternatively, the tubing 26 can contain a gas, such as neon or argon, which may further help in absorbing the kinetic energy from a capsule burst. Also, when containing a gas that is capable of illumination, the tubing can be provided with electrodes 28, 30, to form a second light source 16*a*, which second light source can provide a light output different from that emitted by the first light source capsule 16. See, for example, FIG. 9.

While the transparent structure 19 can be solid rod, as shown in FIG. 5, the tubing is preferred for its reduced weight. In a preferred embodiment of the invention, when used as a containment vessel in a 400 watt metal halide lamp, the tubing has an ID of 3 mm and an OD of 5 mm. The outer diameter of the helix was about 43 mm and the overall length was about 7 cm. When a wire was employed, the wire was nickel and was 0.015 inches in diameter and approximately 1.1 meter in length. The actual dimensions will vary in accordance with the size of the light source capsule being protected.

Figure 10:
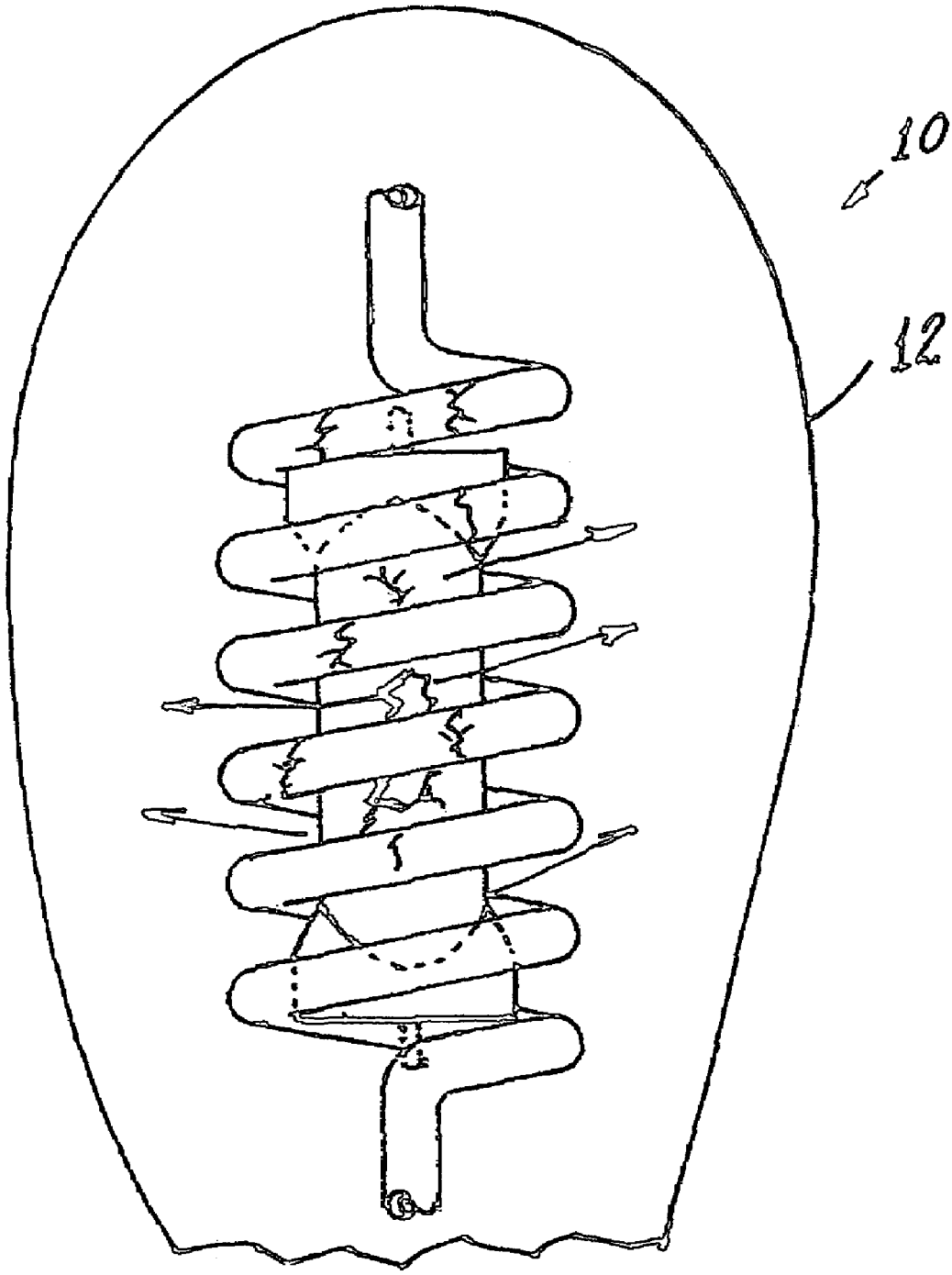
FIG. 10 is a diagrammatic representation of the fractures resulting from a burst light source capsule.

The spacing of the coils in the helix is important and preferably is equal to or less than the diameter of the tubing. If the spacing is too large it is possible for large shards having sufficient kinetic energy to escape the containment vessel and fracture the outer envelope. On the lower level, the spacing should be nonzero; i.e., there must be some space between the coils to prevent a crack from propagating laterally across turns of the tubing. That is, when the tubing has a diameter D, the spacing between turns is D1, where D1 is equal to or less than D but greater than zero, as is shown in FIG. 2. While the spacing is shown as being consistent, it is possible for the spacing to be varied so long as it remains nonzero at the lower range and at the upper range is not large enough to permit heavy shards from exiting through the spaces. This ensures that the fractures remain small and localized at or very near their impact sites. Thus, the fractures are effectively distributed according to the random directions along which the shards travel. Each fracture independently absorbs energy from its corresponding shard impact. The total energy absorbed is greater than it would be if the containment vessel were a rigid continuum. Additionally, the spacing between the turns of the coils allows the pressurized gas within the capsule to escape laterally, a condition not possible with the solid wall tubular shroud. A diagrammatic representation of a burst and the independent fractures resulting is shown in FIG. 10

Figure 7:
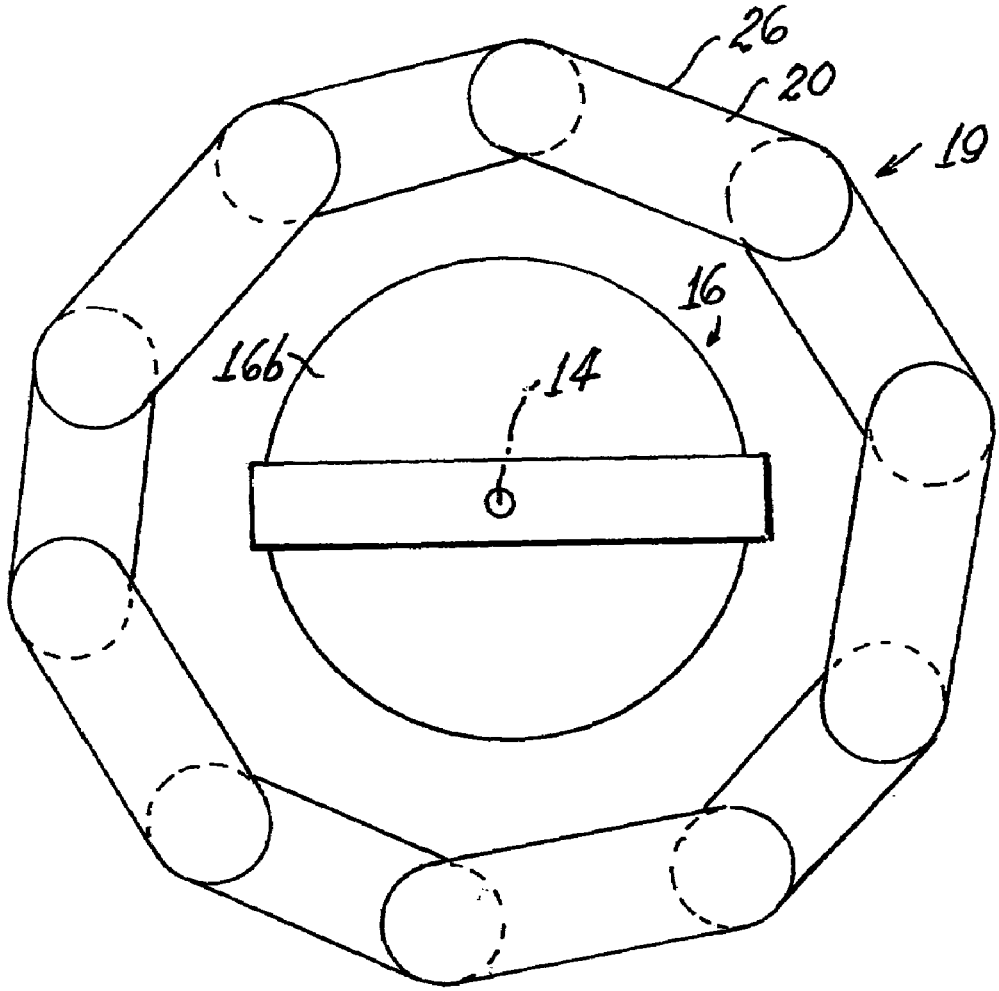
FIG. 7 is plan view of an alternate configuration for a containment vessel.
Figure 8:
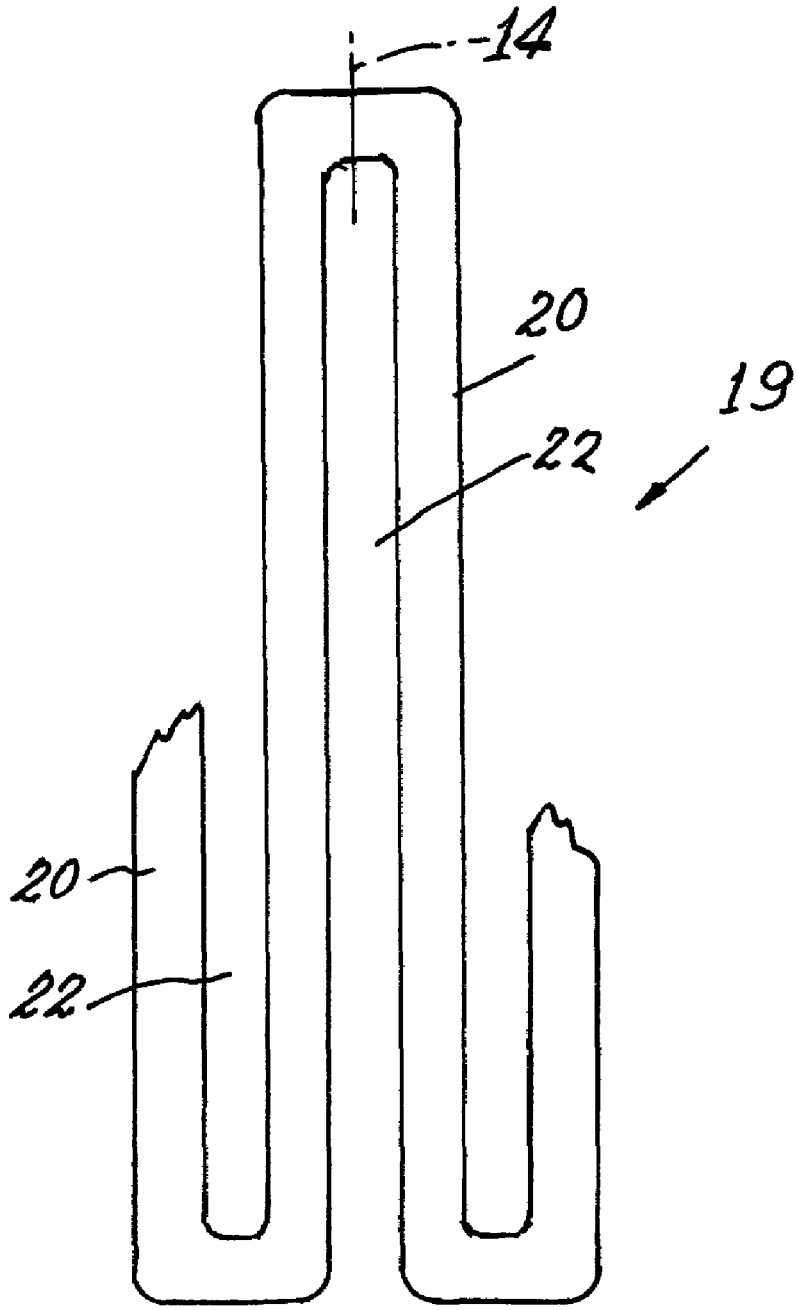
FIG. 8 is a partial, elevational view of the containment vessel shown in FIG. 7.

Referring now to FIGS. 7 and 8 an alternative transparent structure 19 of solid areas 20 and spaces 22 can be realized via a multiplicity of U-shaped channels aligned parallel to the longitudinal axis 14 of the lamp 10.

Referring again to FIG. 5, it will be seen that a lamp 10 comprises an envelope 12 having a base end 12*a*, a middle portion 12*b* and domed end 12*c* arrayed along the envelope longitudinal axis 14. Two spaced apart electrical lead-ins 34, 36, are sealed in the base end 12*a* and extend into the envelope 12. A substantially U-shaped frame 38 is positioned within envelope 12, the U-shaped frame being comprised of glass tubing 26*a*. The light source capsule 16 in this instance comprises an arc discharge capsule 16*b* positioned within the frame 38 and the containment vessel 18 and, as noted, can be supported in any suitable manner. The containment vessel 18 is spaced from and surrounds the arc discharge capsule 16*b*. The containment vessel 18 preferably is integrally formed with the frame 38.

The frame 38 can be positioned within the envelope 12 by fitting the ends 38*a*, 38*b* over the electrical lead-ins 34, 36. The opposite end 38*c* of the frame 38 is received in the domed end 12*c* of the envelope 12. To insure a friction fit within the domed end 12*c*, the end 38*c* of the frame 38 can be provided with a spring section 38*d* to allow for tolerance variations in the envelope dimensions. Alternatively, the frame end 38*c* can be made smaller than the internal dimension of the domed end 12*c* and be provided with snubbers, as known in the art.

The use of the transparent glass frame 38 eliminates the shadowing effect present in lamps that use wire frames. Also, the use of the electrically isolating glass frame eliminates the sodium loss occasioned by the photoelectric effect when wire frames are used.

The invention is useful also with other types of lamps employing light source capsules. In FIG. 6 is shown a lamp 10*a* having an envelope 12*a* and a light source capsule 16*c* such as a tungsten halogen capsule. Light source capsule 16*c* operates also at pressures above the pressure of the surrounding environment. In the past, these lamps employed a relatively heavy outer envelope to contain shards in the event of a capsule burst; however, as shown in FIG. 6, the light source capsule 16*c* can be protected by a containment vessel 18 allowing the lamp to use a diminished thickness glass envelope, thus reducing weight and cost.

Thus there is provided a containment vessel for lamps using light source capsules that operate at greater than (or substantially less than) the pressure of the surrounding gas. The containment vessel is lightweight and eliminates the shadowing effect caused by wire frames. It is more effective than prior art quartz tubular shrouds because it absorbs more energy from impinging glass shards, thereby enhancing the breakup of the shards themselves, reducing their size and velocity. This reduces the energy and momentum with which the residual shattered glass of the light source capsule strikes the inside surface of the outer envelope.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. In a lamp having an envelope with a longitudinal axis and with a light source capsule contained therein, said light source capsule being capable of shattering into shards with a given kinetic energy able to fracture said envelope, the improvement comprising:

a containment vessel spaced from and surrounding said light source capsule, said containment vessel comprising a transparent structure formed to provide multiple, independent, localized fractures capable of absorbing said given kinetic energy possessed by said shards, wherein said transparent structure is selected from glass or ceramic and having alternating solid areas and spaces.

2. The lamp of claim 1 wherein said containment vessel is a helix having a helix longitudinal axis substantially coaxial with said envelope longitudinal axis.

3. The lamp of claim 2 wherein said helix is constructed of tubing and said spaces are formed between turns of said helix.

4. The lamp of claim 3 wherein said tubing is gas-filled.

5. The lamp of claim 4 wherein said gas is selected from the group of argon and neon.

6. The lamp of claim 5 wherein said tubing is sealed and contains an electrode at each end to form a second light source within said outer envelope.

7. The lamp of claim 6 wherein said light source capsule emits light of a first color and said second light source emits light of a different color.

8. The lamp of claim 3 wherein said tubing contains a refractory wire threaded therethrough.

9. The lamp of claim 3 wherein said tubing has a given diameter D and said spaces have a dimension D1 equal to or less than said given diameter D when measured along said helix longitudinal axis.

10. The lamp of claim 1 wherein said solid areas and said spaces extend parallel to said envelope longitudinal axis.

11. A high intensity discharge lamp comprising an envelope having a base end, a middle portion and domed end arrayed along an envelope longitudinal axis;

two spaced apart electrical lead-ins sealed in said base end and extending into said envelope;

a substantially U-shaped frame within said envelope, said U-shaped frame comprised of glass tubing;

a light source capsule comprising an arc discharge capsule positioned within said frame; and a containment vessel spaced from and surrounding said light source capsule, said containment vessel comprising a transparent structure formed to provide multiple, independent, localized fractures capable of absorbing said given kinetic energy possessed by said shards and being attached to said frame.

12. The lamp of claim 11 wherein said helix is constructed of solid rod.

13. The lamp of claim 11 wherein said transparent structure is selected from glass or ceramic and having alternating solid areas and spaces.

14. The lamp of claim 13 wherein said containment vessel is a helix having a helix longitudinal axis substantially coaxial with said envelope longitudinal axis.

15. The lamp of claim 14 wherein said helix is constructed of tubing and said spaces are formed between turns of said helix.

16. The lamp of claim 15 wherein said tubing is gas-filled.

17. The lamp of claim 16 wherein said gas is selected from the group of argon and neon.

18. The lamp of claim 17 wherein said tubing is sealed and contains an electrode at each end to form a second light source within said outer envelope.

19. The lamp of claim 14 wherein said helix is constructed of solid rod.

20. The lamp of claim 15 wherein said tubing contains a refractory wire threaded therethrough.

21. The lamp of claim 15 wherein said tubing has a given diameter D and said spaces have a dimension D1 equal to or less than said given diameter D when measured along said helix longitudinal axis.

22. The lamp of claim 13 wherein said solid areas and said spaces extend parallel to said envelope longitudinal axis.

23. The lamp of claim 18 wherein said light source capsule emits light of a first color and said second light source emits light of a different color.

24. The lamp of claim 2, 3, 4, 5, 6, 12, 8, 9, 7, 14, 15, 16, 17, 18, 19, 20, or 21 wherein said helix is bifilar.

* * * * *